US012215710B2

(12) United States Patent
Mori et al.

(10) Patent No.: US 12,215,710 B2
(45) Date of Patent: Feb. 4, 2025

(54) CENTRIFUGAL COMPRESSOR

(71) Applicant: KABUSHIKI KAISHA TOYOTA JIDOSHOKKI, Aichi (JP)

(72) Inventors: Hidefumi Mori, Kariya (JP); Junya Suzuki, Kariya (JP); Ryo Umeyama, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 174 days.

(21) Appl. No.: 18/119,603

(22) Filed: Mar. 9, 2023

(65) Prior Publication Data

US 2023/0296107 A1 Sep. 21, 2023

(30) Foreign Application Priority Data

Mar. 15, 2022 (JP) ..... 2022-040086
Oct. 19, 2022 (JP) ..... 2022-167614

(51) Int. Cl.

| | |
|---|---|
| ***F04D 29/42*** | (2006.01) |
| ***F04D 17/10*** | (2006.01) |
| ***F04D 25/06*** | (2006.01) |
| ***F04D 25/08*** | (2006.01) |
| ***F04D 29/44*** | (2006.01) |

(52) U.S. Cl.

CPC ..... *F04D 29/4206* (2013.01); *F04D 17/10* (2013.01); *F04D 25/06* (2013.01); *F04D 25/082* (2013.01); *F04D 29/441* (2013.01)

(58) Field of Classification Search

CPC .. F04D 13/0646; F04D 13/0666; F04D 17/10; F04D 25/06; F04D 25/08; F04D 25/082; F04D 29/441; F04D 29/5806

USPC ..... 417/423.11, 368, 371

See application file for complete search history.

(56) References Cited

U.S. PATENT DOCUMENTS

| | | | | |
|---|---|---|---|---|
| 3,667,870 | A * | 6/1972 | Yoshida et al. | F04D 13/0646 417/357 |
| 8,568,111 | B2 | 10/2013 | Knoop | |
| 11,221,011 | B2 | 1/2022 | Wiedmann | |
| 2010/0111725 | A1 * | 5/2010 | Knoop | F04D 29/588 417/372 |

FOREIGN PATENT DOCUMENTS

| | | | |
|---|---|---|---|
| JP | 2010-516930 | A | 5/2010 |
| JP | 2011-202588 | A | 10/2011 |
| JP | 6968253 | B2 | 11/2021 |

* cited by examiner

*Primary Examiner* — Philip E Stimpert
(74) *Attorney, Agent, or Firm* — Greenblum & Bernstein, P.L.C.

(57) ABSTRACT

A centrifugal compressor includes: a compressor impeller; a motor including a stator and a rotor; and a housing. The rotor includes a tubular member, a magnetic body, a first shaft member and a second shaft member, an axial passage, and a plurality of radial passages. A dimension of each of the radial passages in a circumferential direction of the second shaft member gradually increases toward a radially outward side of the second shaft member. Each of the radial passages includes an opening that is opened at the outer peripheral surface of the second shaft member. The outer peripheral surface of the second shaft member has an interposed surface that is interposed between the opening of one of the radial passages and the opening of another of the radial passages adjacent to each other in the circumferential direction of the second shaft member.

4 Claims, 10 Drawing Sheets

CENTRIFUGAL COMPRESSOR

CROSS-REFERENCE TO RELATED APPLICATION

This application claims priorities to Japanese Patent Application No. 2022-040086 filed on Mar. 15, 2022 and Japanese Patent Application No. 2022-167614 filed on Oct. 19, 2022, the entire disclosure of which is incorporated herein by reference.

BACKGROUND ART

The present disclosure relates to a centrifugal compressor.

The centrifugal compressor includes a compressor impeller, a motor, and a housing. The compressor impeller compresses air. The motor rotates the compressor impeller. The housing includes an impeller chamber, a motor chamber, and an inlet. The impeller chamber accommodates the compressor impeller. The motor chamber accommodates the motor. Air is drawn from the inlet into the impeller chamber.

The motor includes a stator and a rotor. The stator is fixed to the housing. The rotor is disposed inside the stator. The rotor may include a tubular member, a magnetic body, a first shaft member, and a second shaft member. The magnetic body is fixed inside the tubular member. The first shaft member and the second shaft member are disposed at opposite ends of the magnetic body in an axial direction of the tubular member. The compressor impeller is connected to the first shaft member, for example.

In this kind of centrifugal compressor, heat is generated in the magnetic body due to eddy current generated in the magnetic body. Then, for example, as disclosed in Japanese Patent Application No. 2011-202588, part of air compressed by the compressor impeller may be introduced into the motor chamber. The compressed air is introduced into the motor chamber, so that the magnetic body is cooled by the compressed air.

However, a temperature of the air compressed by the compressor impeller is higher as compared with air before compression, which may result in insufficient cooling of the magnetic body. Therefore, in this kind of centrifugal compressor, it is desirable to efficiently cool the magnetic body.

SUMMARY

In accordance with an aspect of the present disclosure, there is provided a centrifugal compressor that includes: a compressor impeller that compresses air; a motor that rotates the compressor impeller; and a housing including an impeller chamber accommodating the compressor impeller, a motor chamber accommodating the motor, and an inlet from which air is drawn into the impeller chamber. The motor includes a stator fixed to the housing and a rotor disposed inside the stator. The rotor includes a tubular member, a magnetic body fixed to an inside of the tubular member, and a first shaft member and a second shaft member on opposite sides of the magnetic body in an axial direction of the tubular member. The compressor impeller is connected to the first shaft member. The rotor further includes: an axial passage that extends inside the rotor in an axial direction of the rotor and is opened at one end of the first shaft member close to the compressor impeller to communicate with the inlet; and a plurality of radial passages that communicates with the axial passage and extends from the axial passage toward an outer peripheral surface of the second shaft member to communicate with an inside of the motor chamber. The housing includes a discharge port from which air introduced from the inlet into the motor chamber is discharged to an outside of the housing. A dimension of each of the radial passages in a circumferential direction of the second shaft member gradually increases toward a radially outward side of the second shaft member. Each of the radial passages includes an opening that is opened at the outer peripheral surface of the second shaft member. The outer peripheral surface of the second shaft member has an interposed surface that is interposed between the opening of one of the radial passages and the opening of another of the radial passages adjacent to each other in the circumferential direction of the second shaft member. A dimension of the interposed surface in the circumferential direction of the second shaft member is smaller than a dimension of the opening in the circumferential direction of the second shaft member.

In accordance with another aspect of the present disclosure, there is provided a centrifugal compressor that includes: a compressor impeller that compresses air; a motor that rotates the compressor impeller; and a housing including an impeller chamber accommodating the compressor impeller, a motor chamber accommodating the motor, and an inlet from which air is drawn into the impeller chamber. The motor includes a stator fixed to the housing and a rotor disposed inside the stator. The rotor includes a tubular member, a magnetic body fixed to an inside of the tubular member, and a first shaft member and a second shaft member on opposite sides of the magnetic body in an axial direction of the tubular member. The compressor impeller is connected to the first shaft member. The rotor further includes: an axial passage that extends inside the rotor in an axial direction of the rotor, and is opened at one end of the first shaft member close to the compressor impeller to communicate with the inlet; and a plurality of radial passages that communicates with the axial passage and extends from the axial passage toward an outer peripheral surface of the first shaft member to communicate with an inside of the motor chamber. The housing includes a discharge port from which air introduced from the inlet into the motor chamber is discharged to an outside of the housing. A dimension of each of the radial passages in a circumferential direction of the first shaft member gradually increases toward a radially outward side of the first shaft member. Each of the radial passages includes an opening that is opened at the outer peripheral surface of the first shaft member. The outer peripheral surface of the first shaft member has an interposed surface that is interposed between the opening of one of the radial passages and the opening of another of the radial passages adjacent to each other in the circumferential direction of the first shaft member. A dimension of the interposed surface in the circumferential direction of the first shaft member is smaller than a dimension of the opening in the circumferential direction of the first shaft member.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

First Embodiment

The following will describe a centrifugal compressor of the first embodiment with reference to FIG. 1 to FIG. 7. The centrifugal compressor of the present embodiment is mounted on a fuel cell vehicle. The centrifugal compressor compresses air.

Centrifugal Compressor 10

Figure 1:
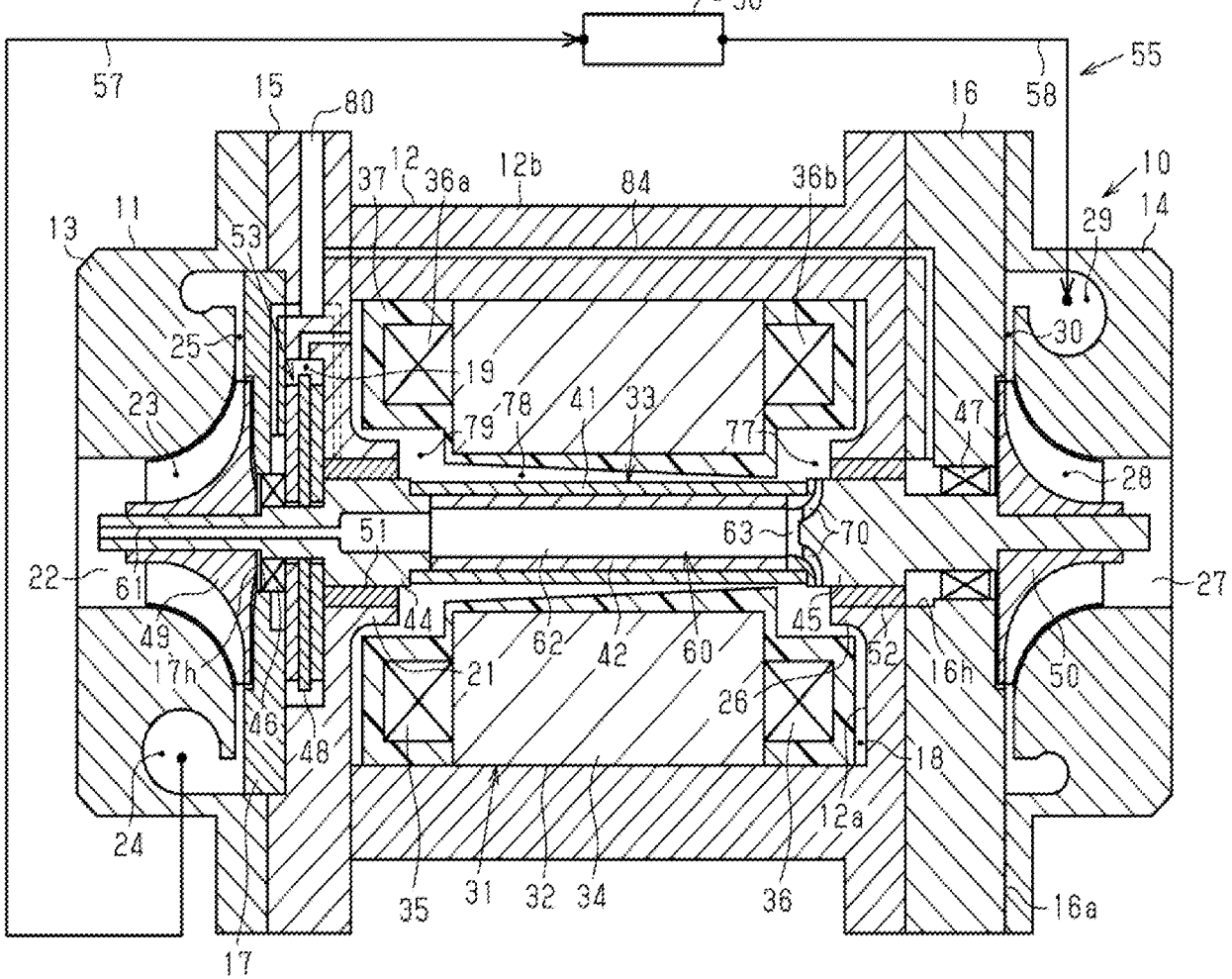
FIG. 1 is a cross-sectional view of a centrifugal compressor according to a first embodiment.

As illustrated in FIG. 1, a centrifugal compressor 10 includes a housing 11. The housing 11 is made of a metallic material such as aluminum. The housing 11 has a tubular shape. The housing 11 includes a motor housing 12, a compressor housing 13, a turbine housing 14, a first plate 15, a second plate 16, and a seal plate 17.

The motor housing 12 has a tubular shape. The motor housing 12 has an end wall 12*a* having a plate shape, and a peripheral wall 12*b*. The peripheral wall 12*b* extends in the tubular shape from an outer periphery of the end wall 12*a*. The first plate 15 is connected to and closes an opened end of the peripheral wall 12*b* of the motor housing 12. The end wall 12*a* and the peripheral wall 12*b* of the motor housing 12, and the first plate 15 define a motor chamber 18. Thus, the housing 11 includes the motor chamber 18.

Figure 2:
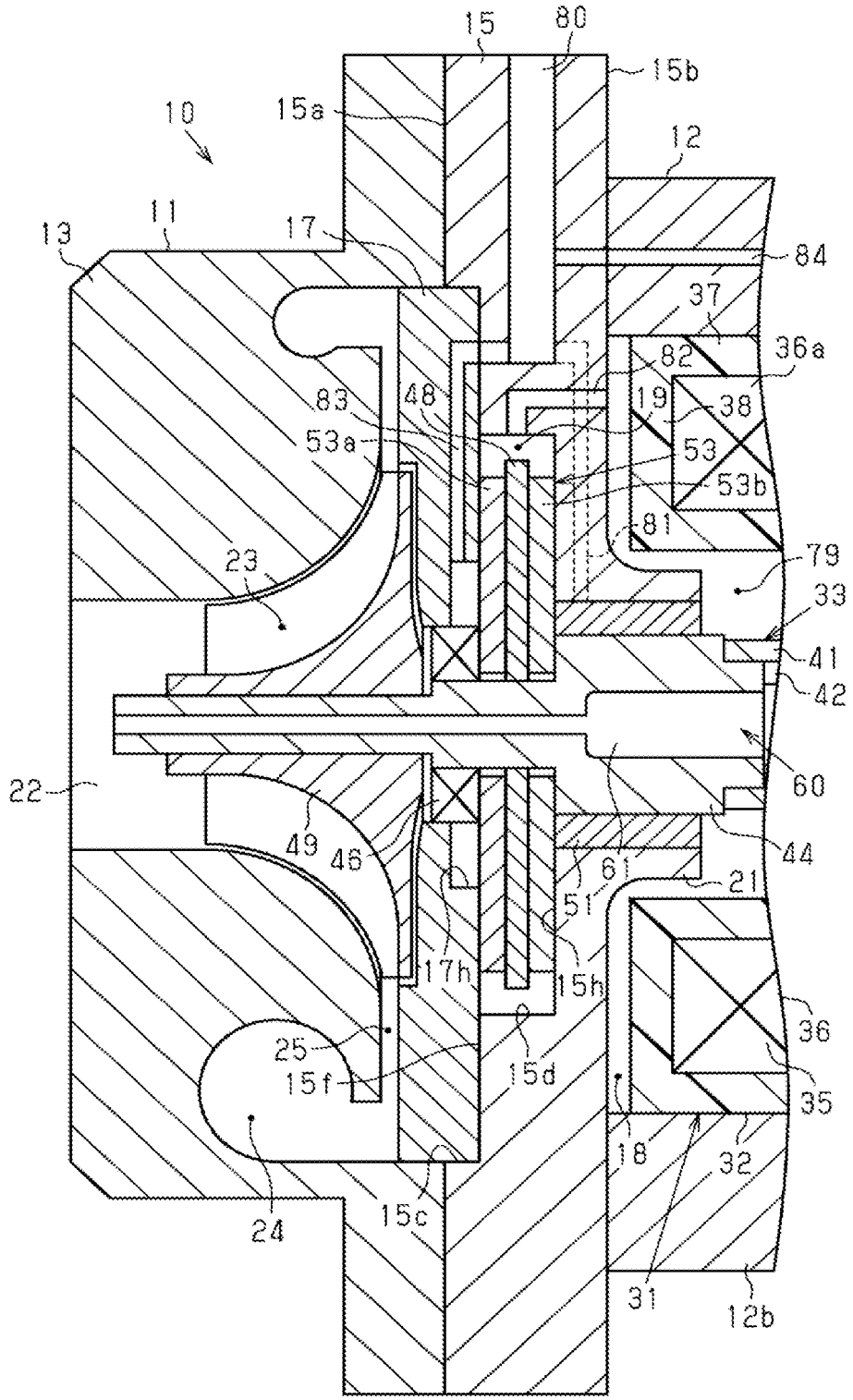
FIG. 2 is an enlarged cross-sectional view of a part of the centrifugal compressor.

As illustrated in FIG. 2, the first plate 15 has a first recess 15*c* and a second recess 15*d*. The first recess 15*c* and the second recess 15*d* are formed in an end surface 15*a* of the first plate 15, which is opposite from the motor housing 12. The first recess 15*c* and the second recess 15*d* each have a circular hole shape. An inner diameter of the first recess 15*c* is greater than that of the second recess 15*d*. The second recess 15*d* is formed in a bottom surface 15*f* of the first recess 15*c*. The first recess 15*c* is formed coaxially with the second recess 15*d*.

The seal plate 17 is fitted into the first recess 15*c*. The seal plate 17 is attached to the first plate 15 with a bolt (not illustrated), for example. The seal plate 17 closes an opening of the second recess 15*d*. The seal plate 17 and the second recess 15*d* define a thrust bearing accommodation chamber 19. Therefore, the housing 11 includes the thrust bearing accommodation chamber 19.

The seal plate 17 has a shaft insertion hole 17*h*. The shaft insertion hole 17*h* is formed at a central portion of the seal plate 17. The shaft insertion hole 17*h* is opened at the thrust bearing accommodation chamber 19.

The first plate 15 includes a first radial bearing holding portion 21. The first radial bearing holding portion 21 has a cylindrical shape. The first radial bearing holding portion 21 projects into the motor chamber 18 from a central portion of an end surface 15*b* of the first plate 15 that is close to the motor housing 12. The first radial bearing holding portion 21 communicates with the motor chamber 18. The first radial bearing holding portion 21 extends through the first plate 15, and is opened at a bottom surface 15*h* of the second recess 15*d*. Thus, the first radial bearing holding portion 21 communicates with the thrust beating accommodation chamber 19. The first radial bearing holding portion 21 is formed coaxially with the first recess 15*c* and the second recess 15*d*.

The compressor housing 13 has a tubular shape. The compressor housing 13 has an inlet 22 having a circular hole shape. Thus, the housing 11 has the inlet 22. The compressor housing 13 is connected to the end surface 15*a* of the first plate 15 in a state where the inlet 22 is formed coaxially with the shaft insertion hole 17*h* of the seal plate 17. The inlet 22 is opened at an end surface of the compressor housing 13 that is opposite from the first plate 15.

An impeller chamber 23, a discharge chamber 24, and a compressor diffuser passage 25 are provided between the compressor housing 13 and the seal plate 17. Thus, the housing 11 includes an impeller chamber 23. The seal plate 17 partitions the impeller chamber 23 and the thrust bearing accommodation chamber 19. The impeller chamber 23 communicates with the inlet 22. The impeller chamber 23 has a substantially truncated cone hole shape whose diameter gradually increases from the inlet 22 toward the seal plate 17. The discharge chamber 24 extends about an axis of the inlet 22 around the impeller chamber 23. The impeller chamber 23 communicates with the discharge chamber 24 through the compressor diffuser passage 25. The impeller chamber 23 communicates with the shaft insertion hole 17*h* of the seal plate 17.

Figure 3:
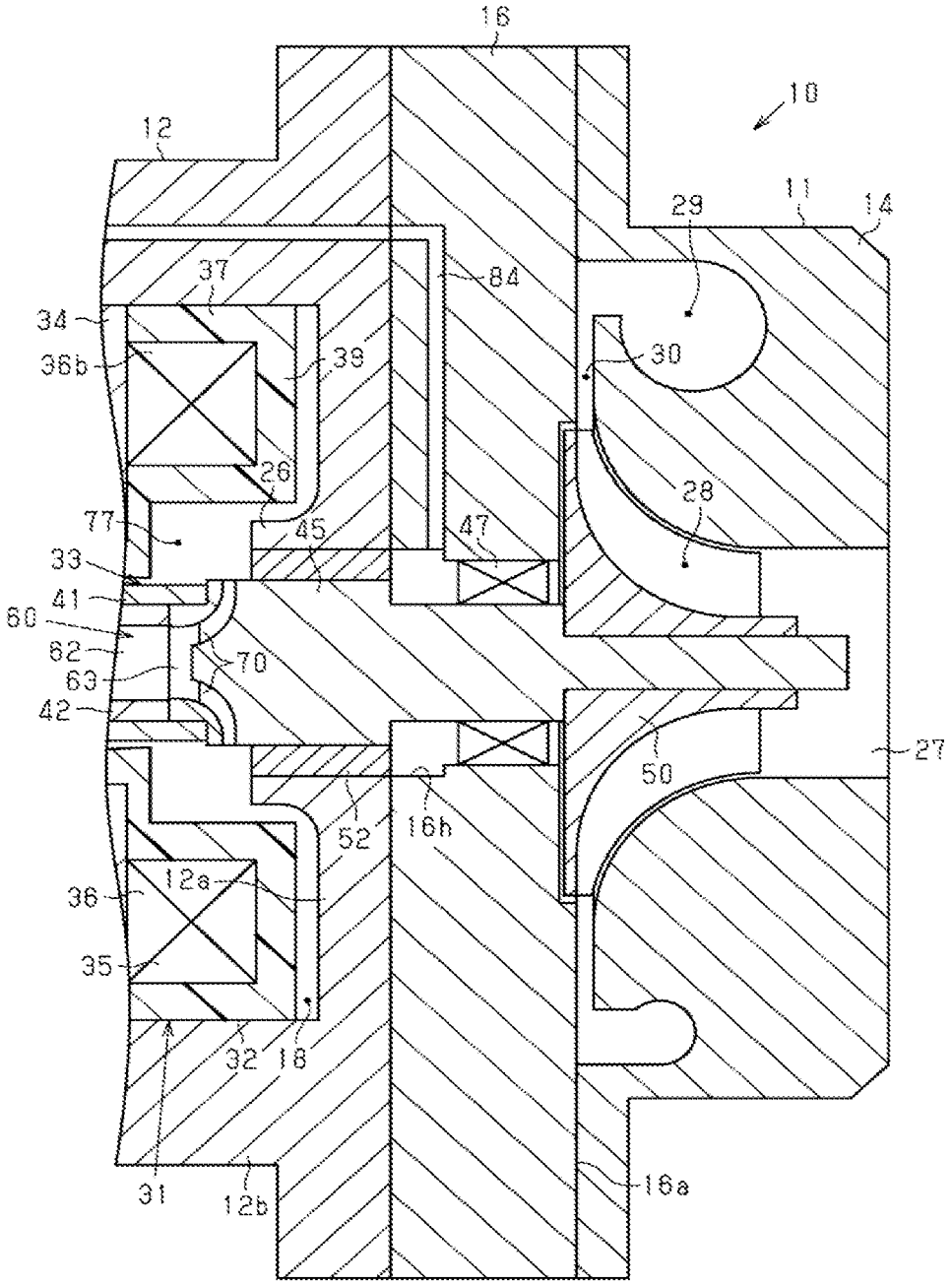
FIG. 3 is an enlarged cross-sectional view of a part of the centrifugal compressor.

As illustrated in FIG. 3, the motor housing 12 includes a second radial bearing holding portion 26. The second radial bearing holding portion 26 has a cylindrical shape. The second radial bearing holding portion 26 projects into the motor chamber 18 from a central portion of an internal surface of the end wall 12*a* of the motor housing 12. The second radial bearing holding portion 26 communicates with the motor chamber 18. An inside of the second radial bearing holding portion 26 extends through the end wall 12*a* of the motor housing 12 and is opened at an outer surface of the end wall 12*a*. The first radial bearing holding portion 21 is formed coaxially with the second radial beating holding portion 26.

The second plate 16 is connected to the outer surface of the end wall 12*a* of the motor housing 12. The second plate 16 has a shaft insertion hole 16*h*. The shaft insertion hole 16*h* is formed at a central portion of the second plate 16.

The turbine housing 14 has a tubular shape. The turbine housing 14 has an outlet 27 having a circular hole shape. The turbine housing 14 is connected to an end surface 16*a* of the second plate 16 that is opposite from the motor housing 12 in a state where the outlet 27 is formed coaxially with the shaft insertion hole 16*h* of the second plate 16. The outlet 27 is opened at an end surface of the turbine housing 14 that is opposite from the second plate 16.

A turbine chamber 28, a turbine scroll passage 29, and a communication passage 30 are formed between the turbine housing 14 and the end surface 16*a* of the second plate 16. The turbine chamber 28 communicates with the outlet 27. The turbine scroll passage 29 extends about an axis of the outlet 27 around the turbine chamber 28. The turbine chamber 28 communicates with the turbine scroll passage 29 through the communication passage 30. The turbine chamber 28 communicates with the shaft insertion hole 16*h* of the second plate 16.

Motor 31

As illustrated in FIG. 1, the centrifugal compressor 10 includes a motor 31. The motor chamber 18 accommodates the motor 31. That is, the housing 11 accommodates the motor 31.

The motor 31 includes a stator 32 and a rotor 33. The stator 32 includes a stator core 34 having a tubular shape and a coil 35. The coil 35 is wound around the stator core 34. The stator core 34 is fixed onto an inner peripheral surface of the peripheral wall 12*b* of the motor housing 12. Thus, the stator 32 is fixed to the housing 11. The coil 35 has coil ends 36 projecting on opposite end surfaces of the stator core 34. In the following description, a "first coil end 36*a*" refers to one of the coil ends 36 on one of the opposite end surfaces of the stator core 34 that is close to the first plate 15, and a "second coil end 36*b*" refers to the other of the coil ends 36 on the other of the opposite end surfaces of the stator core 34 that is close to the end wall 12*a* of the motor housing 12.

Figure 4:
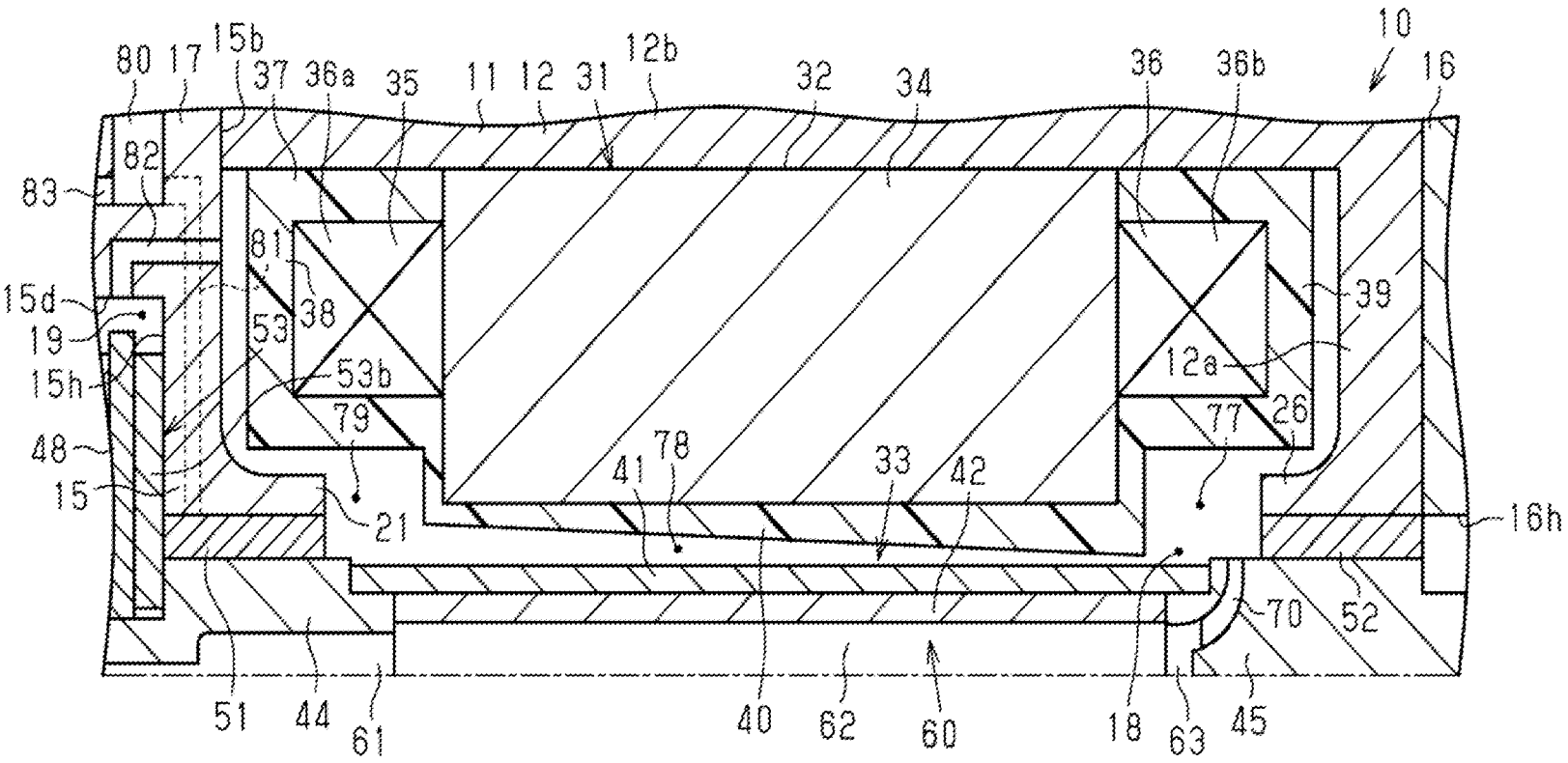
FIG. 4 is an enlarged cross-sectional view of a part of the centrifugal compressor.

As illustrated in FIG. 4, the stator 32 includes a resin member 37. The resin member 37 covers the stator core 34 and the coil ends 36. The resin member 37 includes a first resin portion 38, a second resin portion 39, and a third resin portion 40. Thus, the stator 32 includes the first resin portion 38, the second resin portion 39, and the third resin portion 40. The first resin portion 38 has a tubular shape and covers the first coil end 36*a* with a resin. The second resin portion 39 has a tubular shape and covers the second coil end 36*b* with the resin. The third resin portion 40 has a tubular shape and covers an inner peripheral surface of the stator core 34. The third resin portion 40 extends in an axial direction of the stator core 34 inside the stator core 34. The third resin portion 40 connects the first resin portion 38 and the second resin portion 39. An inner peripheral surface of the third resin portion 40 has a conical hole shape and an inner diameter of the third resin portion 40 gradually increases from the second resin portion 39 toward the first resin portion 38.

Rotor 33

The rotor 33 is disposed inside the stator 32. The rotor 33 includes a tubular member 41, a permanent magnet 42 serving as a magnetic body, a first shaft member 44, and a second shaft member 45. The tubular member 41 is made of titanium alloy, for example. The tubular member 41 has a tubular shape and an axis of the tubular member 41 extends linearly. An axial direction of the tubular member 41 coincides with that of the rotor 33. An outer diameter of the tubular member 41 is fixed in a constant size. Thus, an outer peripheral surface of the tubular member 41 extends in the axial direction of the rotor 33.

The permanent magnet 42 has a cylindrical shape. The permanent magnet 42 is disposed inside the tubular member 41. The permanent magnet 42 is formed coaxially with the tubular member 41. The permanent magnet 42 is press-fitted into the inner peripheral surface of the tubular member 41. The permanent magnet 42 is thus fixed inside the tubular member 41. The permanent magnet 42 is magnetized in a radial direction of the permanent magnet 42. Specifically, the permanent magnet 42 having the cylindrical shape is magnetized in the radial direction of the permanent magnet 42 to have a north pole on one side of the permanent magnet 42 and a south pole on the other side of the permanent magnet 42 in its radial direction.

A dimension of the permanent magnet 42 in its axial direction is smaller than that of the tubular member 41 in its axial direction. The permanent magnet 42 has opposite end surfaces positioned inside the tubular member 41. The tubular member 41 has opposite end portions in its axial direction projecting beyond the opposite end surfaces of the permanent magnet 42 in its axial direction. The opposite end portions of the tubular member 41 project beyond the opposite end surfaces of the stator core 34 in its axial direction.

As illustrated in FIG. 1, the first shaft member 44 and the second shaft member 45 are disposed on opposite sides of the permanent magnet 42 in the axial direction of the tubular member 41. The first shaft member 44 and the second shaft member 45 are made of iron, for example.

The first shaft member 44 has a cylindrical shape. A first end of the first shaft member 44 is inserted into a first end of the tubular member 41. The first end of the first shaft member 44 is press-fitted into an inner peripheral surface of the first end of the tubular member 41. Thus, the first shaft member 44 is fixed to the tubular member 41. A second end of the first shaft member 44 extends through the motor chamber 18, an inside of the first radial bearing holding portion 21, the thrust bearing accommodation chamber 19, and the shaft insertion hole 17*h*, and projects into the impeller chamber 23.

The second shaft member 45 has a cylindrical shape. A first end of the second shaft member 45 is inserted into the second end of the tubular member 41. The first end of the second shaft member 45 is press-fitted into an inner peripheral surface of the second end of the tubular member 41. Thus, the second shaft member 45 is fixed to the tubular member 41. A second end of the second shaft member 45 extends through the motor chamber 18, an inside of the second radial bearing holding portion 26, and the shaft insertion hole 16*h*, and projects into the turbine chamber 28.

The centrifugal compressor 10 includes a first sealing member 46. The first sealing member 46 is provided between the shaft insertion hole 17*h* of the seal plate 17 and the first shaft member 44. The first sealing member 46 prevents leakage of air flowing from the impeller chamber 23 toward the motor chamber 18. The centrifugal compressor 10 includes a second sealing member 47. The second sealing member 47 is provided between the shaft insertion hole 16*h* of the second plate 16 and the second shaft member 45. The second sealing member 47 prevents leakage of air flowing from the turbine chamber 28 toward the motor chamber 18. Each of the first sealing member 46 and the second sealing member 47 is a seal ring, for example.

The centrifugal compressor 10 includes a support portion 48. The support portion 48 projects annularly from an outer peripheral surface of the first shaft member 44. The support portion 48 has a disk shape. The support portion 48 is fixed to the outer peripheral surface of the first shaft member 44 and extends annularly outward from the outer peripheral surface of the first shaft member 44 in its radial direction.

That is, the support portion 48 is a member independent from the first shaft member 44. The support portion 48 is disposed inside the thrust bearing accommodation chamber 19. The support portion 48 rotates together with the first shaft member 44.

Compressor Impeller 49

The centrifugal compressor 10 includes a compressor impeller 49. The compressor impeller 49 is attached to the second end of the first shaft member 44. Thus, the compressor impeller 49 is connected to the first shaft member 44. The compressor impeller 49 is disposed in the first shaft member 44 closer to the second end of the first shaft member 44 than the support portion 48 is. The compressor impeller 49 has a tubular shape and a diameter of the compressor impeller 49 gradually decreases from a rear surface toward a distal end surface of the compressor impeller 49. The compressor impeller 49 is accommodated in the impeller chamber 23. An outer edge of the compressor impeller 49 extends along an inner peripheral surface of the impeller chamber 23. The compressor impeller 49 rotates together with the first shaft member 44 to compress air.

Turbine Wheel 50

The centrifugal compressor 10 includes a turbine wheel 50. The turbine wheel 50 is mounted to the second end of the second shaft member 45. The turbine wheel 50 is accommodated in the turbine chamber 28. The turbine wheel 50 rotates together with the second shaft member 45.

First Radial Beating 51 and Second Radial Bearing 52

The centrifugal compressor 10 includes a first radial bearing 51 and a second radial bearing 52. The first radial bearing 51 has a cylindrical shape. The first radial bearing 51 is held by the first radial bearing holding portion 21. The second radial bearing 52 has a cylindrical shape. The second radial bearing 52 is held by the second radial bearing holding portion 26.

The first radial bearing 51 rotatably supports the first shaft member 44 in a radial direction. The second radial bearing 52 rotatably supports the second shaft member 45 in the radial direction. The first radial bearing 51 and the second radial bearing 52 rotatably support the rotor 33 in the radial direction at opposite positions of the tubular member 41 in the axial direction of the tubular member 41. The "radial direction" is a direction orthogonal to the axial direction of the tubular member 41.

Thrust Bearing 53

As illustrated in FIG. 2, the centrifugal compressor 10 includes a thrust bearing 53. The thrust bearing 53 is accommodated in the thrust bearing accommodation chamber 19. The thrust bearing 53 includes a first thrust beating portion 53*a* and a second thrust bearing portion 53*b*. The first thrust bearing portion 53*a* and the second thrust bearing portion 53*b* hold therebetween the support portion 48. The first thrust bearing portion 53*a* is disposed close to the compressor impeller 49 relative to the support portion 48. The second thrust bearing portion 53*b* is disposed close to the first radial bearing 51 relative to the support portion 48.

The first thrust bearing portion 53*a* and the second thrust bearing portion 53*b* rotatably support the support portion 48 in a thrust direction. Thus, the thrust bearing 53 rotatably supports the rotor 33 between the compressor impeller 49 and the first radial bearing 51 via the support portion 48. The "thrust direction" is a direction parallel to the axial direction of the tubular member 41. As a result, the rotor 33 is rotatably supported in the housing 11.

Fuel Cell System 55

As illustrated in FIG. 1, the centrifugal compressor 10 with the above-described configuration is a part of the fuel cell system 55 mounted on the fuel cell vehicle. The fuel cell system 55 includes a fuel cell stack 56, a supply passage 57, and a discharge passage 58, in addition to the centrifugal compressor 10. The fuel cell stack 56 is formed of a plurality of fuel cells (not illustrated). The discharge chamber 24 is connected to the fuel cell stack 56 through the supply passage 57. The fuel cell stack 56 is connected to the turbine scroll passage 29 through the discharge passage 58.

When the rotor 33 rotates, the compressor impeller 49 and the turbine wheel 50 rotate together with the rotor 33. Thus, the motor 31 rotates the compressor impeller 49. When the compressor impeller 49 rotates, air is drawn from the inlet 22 into the impeller chamber 23. The air flowing from the inlet 22 is cleaned by an air cleaner (not illustrated).

The air drawn from the inlet 22 is compressed by the compressor impeller 49 in the impeller chamber 23, and then, the compressed air is discharged from the discharge chamber 24 to the supply passage 57 through the compressor diffuser passage 25. The air discharged from the discharge chamber 24 to the supply passage 57 is supplied to the fuel cell stack 56 through the supply passage 57. The air supplied to the fuel cell stack 56 is used for power generation of the fuel cell stack 56. After that, the air having passed through the fuel cell stack 56 is discharged to the discharge passage 58, as exhaust air from the fuel cell stack 56.

The exhaust air from the fuel cell stack 56 is drawn into the turbine scroll passage 29 through the discharge passage 58. The exhaust air from the fuel cell stack 56 drawn into the turbine scroll passage 29 is introduced into the turbine chamber 28 through the communication passage 30. The exhaust air from the fuel cell stack 56 introduced into the turbine chamber 28 rotates the turbine wheel 50. The rotor 33 rotates in response to rotation of the turbine wheel 50 caused by the exhaust air of the fuel cell stack 56 as well as a drive of the motor 31. The rotation of the rotor 33 is assisted by the turbine wheel 50 rotated by the exhaust air from the fuel cell stack 56. The exhaust air having passed through the turbine chamber 28 is discharged from the outlet 27 to an outside.

Axial Passage 60

The rotor 33 includes an axial passage 60. The axial passage 60 includes a first axial passage 61, a second axial passage 62, and a third axial passage 63. The first axial passage 61 extends through an inside of the first shaft member 44 in the axial direction of the first shaft member 44. The first axial passage 61 has a circular hole shape. A first end of the first axial passage 61 is opened at the second end of the first shaft member 44 and communicates with the inlet 22.

The second axial passage 62 extends through an inside of the permanent magnet 42 in the axial direction of the permanent magnet 42. Therefore, the axial passage 60 extends through the permanent magnet 42. The second axial passage 62 has a circular hole shape. A first end of the second axial passage 62 communicates with a second end of the first axial passage 61. The second axial passage 62 is formed coaxially with the first axial passage 61.

The third axial passage 63 extends through an inside of the second shaft member 45 in the axial direction of the second shaft member 45. The third axial passage 63 has a circular hole shape. A first end of the third axial passage 63 communicates with a second end of the second axial passage 62. The third axial passage 63 is formed coaxially with the second axial passage 62. A second end of the third axial passage 63 is disposed inside the second shaft member 45.

As described above, the axial passage 60 extends through the first shaft member 44, the permanent magnet 42, and the second shaft member 45 in the axial direction of the tubular member 41. Therefore, the axial passage 60 extends through the rotor 33 in the axial direction of the rotor 33. Then, the axial passage 60 is opened at one end of the first shaft member 44 close to the compressor impeller 49 to communicate with the inlet 22.

Radial Passage 70

Figure 5:
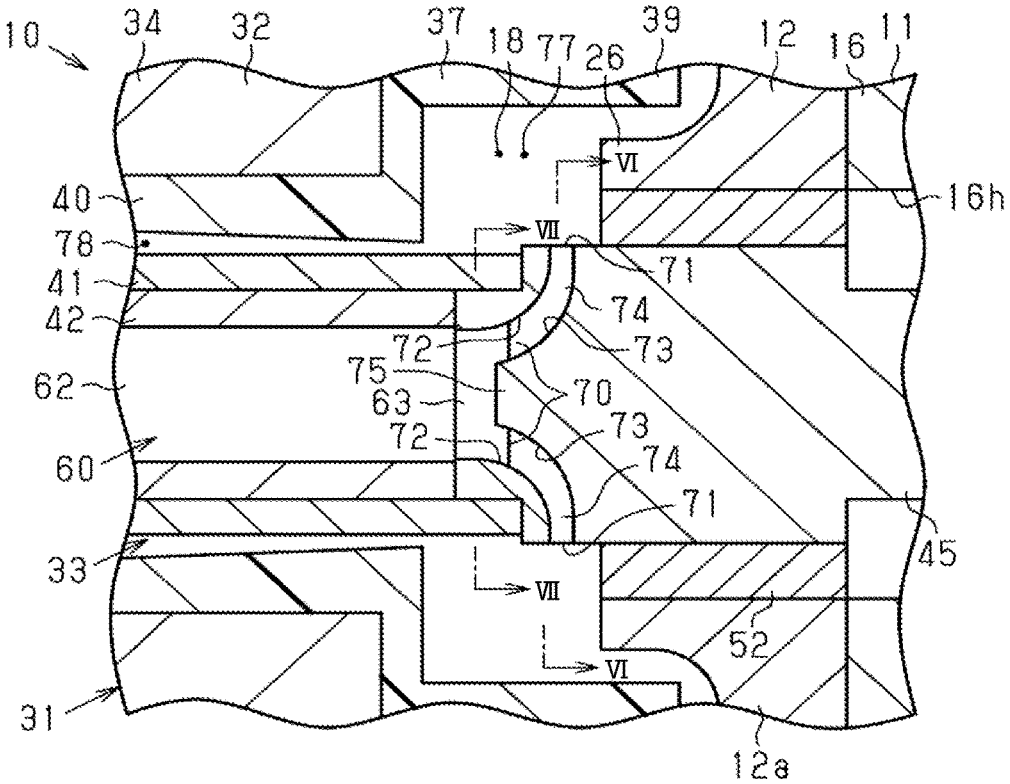
FIG. 5 is an enlarged cross-sectional view of a part of the centrifugal compressor.

As illustrated in FIG. 5, the rotor 33 includes a plurality of radial passages 70. The plurality of radial passages 70 communicates with the second end of the third axial passage 63. Thus, each of the radial passages 70 communicates with the axial passage 60. Each of the radial passages 70 extends from the third axial passage 63 toward the outer peripheral surface of the second shaft member 45. That is, each of the radial passages 70 extends from the axial passage 60 toward the outer peripheral surface of the second shaft member 45. A first end of each of the radial passages 70 communicates with the third axial passage 63. A second end of each of the radial passages 70 is opened at the outer peripheral surface of the second shaft member 45, and communicates with an inside of the motor chamber 18. Specifically, the second end of each of the radial passages 70 communicates with a part of a space inside the motor chamber 18 radially inward with respect to the second resin portion 39. The second end of each of the radial passages 70 serves as an opening 71 that is opened at the outer peripheral surface of the second shaft member 45. That is, each of the radial passages 70 has the opening 71 that is opened at the outer peripheral surface of the second shaft member 45.

Each of the radial passages 70 extends in a direction away from the permanent magnet 42 as being away from the third axial passage 63, i.e., away from the axial passage 60. A surface of each of the radial passages 70 located on a radially outward side of the second shaft member 45 corresponds to a shroud surface 72 curved in an arc shape in a direction in which each of the radial passages 70 extends in a direction away from the permanent magnet 42 as being away from the third axial passage 63. A surface of each of the radial passages 70 located on a radially inward side of the second shaft member 45 corresponds to a hub surface 73 curved in an arc shape in a direction in which each of the radial passages 70 extends in a direction away from the permanent magnet 42 as being away from the third axial passage 63. The hub surface 73 extends along the shroud surface 72. The hub surface 73 gradually approaches the shroud surface 72 as being away from the third axial passage 63. Thus, a dimension of each of the radial passages 70 in the axial direction of the second shaft member 45 gradually decreases toward a radially outward side of the second shaft member 45.

Figure 6:
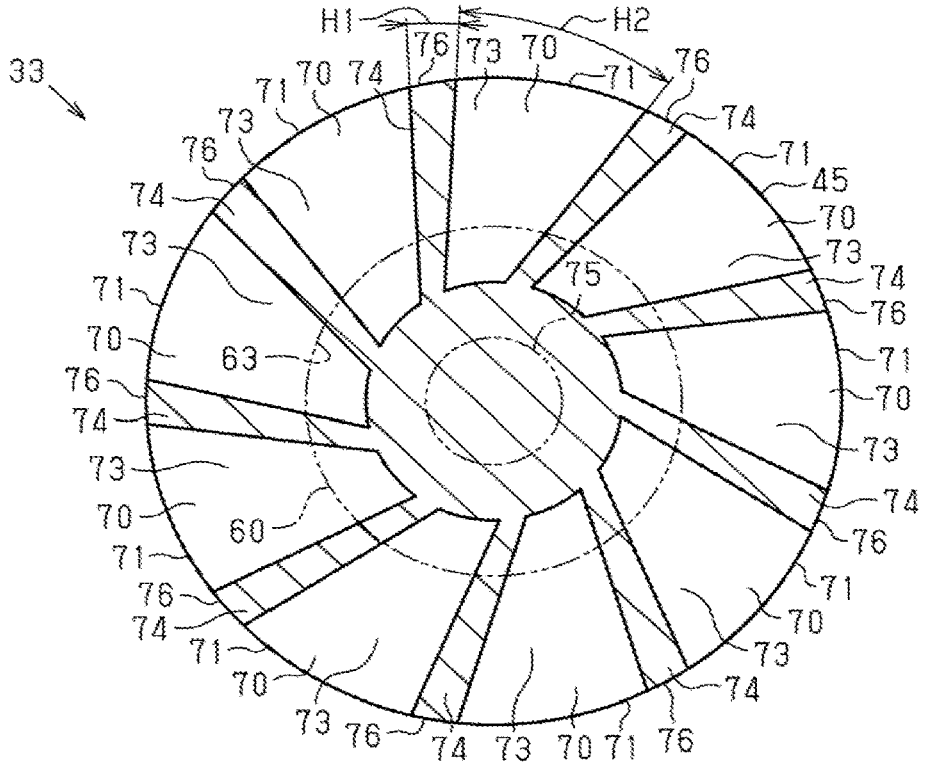
FIG. 6 is a cross-sectional view of the centrifugal compressor, taken along a line VI-VI of FIG. 5.

As illustrated in FIG. 6, the second shaft member 45 includes a plurality of blade walls 74. Each of the blade walls 74 partitions the radial passages 70 adjacent to each other in a circumferential direction of the second shaft member 45. A width of each of the blade walls 74 in the circumferential direction of the second shaft member 45 gradually increases toward the radially outward side of the second shaft member 45.

Figure 7:
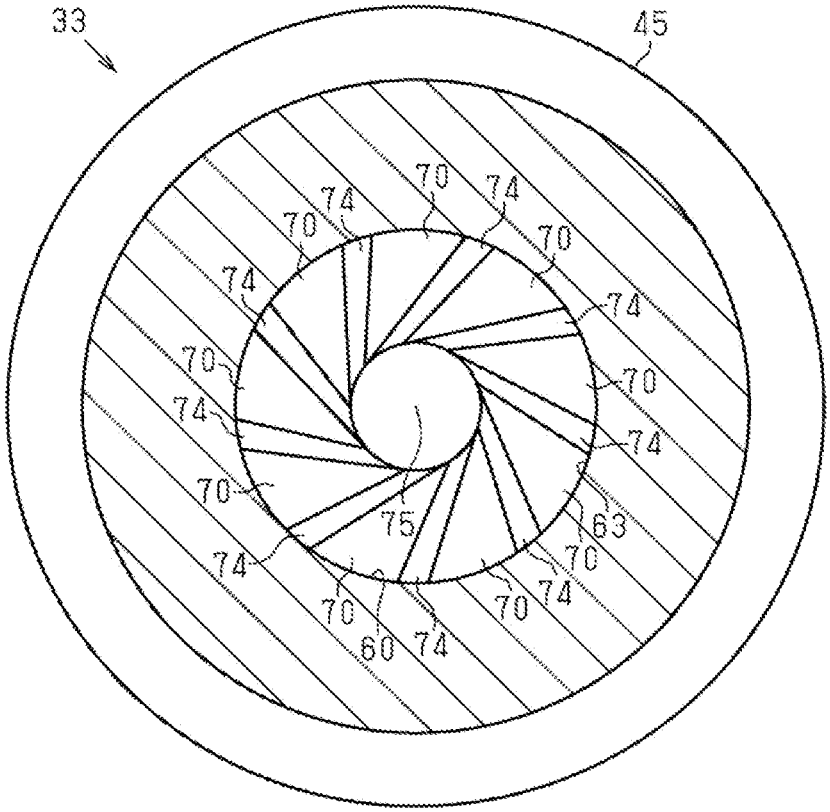
FIG. 7 is a cross-sectional view of the centrifugal compressor, taken along a line VII-VII of FIG. 5.

As illustrated in FIG. 7, the second shaft member 45 includes a core portion 75. The core portion 75 supports each of the blade walls 74. The core portion 75 has a cylindrical columnar shape. The core portion 75 is formed coaxially with the third axial passage 63. An end portion of each of the blade walls 74 located on a radially inward side of the second shaft member 45 is continuous with an outer peripheral surface of the core portion 75. Each of the blade walls 74 extends in a tangential direction of the outer peripheral surface of the core portion 75. An outer diameter of the core portion 75 is smaller than an inner diameter of the third axial passage 63. Therefore, the end portion of each of the blade walls 74 located on a radially inward side of the second shaft member 45 faces an inside of the third axial passage 63. As a result, the first end of each of the radial passages 70 communicates with the third axial passage 63.

As illustrated in FIG. 6, the outer peripheral surface of the second shaft member 45 has a plurality of interposed surfaces 76. Each of the interposed surfaces 76 is interposed between openings 71 of the radial passages 70 adjacent to each other arranged along the circumferential direction of the second shaft member 45. Each of the interposed surfaces 76 is an outer surface of each of the blade walls 74 located on a radially outward side of the second shaft member 45. A dimension of each of the radial passages 70 in the circumferential direction of the second shaft member 45 gradually increases toward the radially outward side of the second shaft member 45. Thus, the opening 71 is a part of each of the radial passages 70 where a dimension thereof in the circumferential direction of the second shaft member 45 is the largest. A dimension H1 of each of the interposed surfaces 76 in the circumferential direction of the second shaft member 45 is smaller than a dimension H2 of the opening 71 in the circumferential direction of the second shaft member 45.

As illustrated in FIG. 1, air is introduced from the inlet 22 to the first end of the first axial passage 61. Then, the air introduced from the inlet 22 into the first axial passage 61 is introduced into an introduction space 77 that is a part of a space inside the motor chamber 18 radially inward with respect to the second resin portion 39, through the first axial passage 61, the second axial passage 62, the third axial passage 63, and the radial passages 70.

Diffuser Passage 78

As illustrated in FIG. 4, the centrifugal compressor 10 includes a diffuser passage 78. The diffuser passage 78 is a space formed between the inner peripheral surface of the third resin portion 40 and the outer peripheral surface of the tubular member 41. Thus, the diffuser passage 78 is disposed between the stator 32 and the rotor 33. Through the diffuser passage 78, the introduction space 77 communicates with a discharge space 79 that is a part of a space inside the motor chamber 18 radially inward with respect to the first resin portion 38. The diffuser passage 78 is narrowed so that the cross-sectional area of the diffuser passage 78 is the smallest at a position closest to the introduction space 77. The cross-sectional area of the diffuser passage 78 is the largest at a position closest to the discharge space 79. Thus, the cross-sectional area of the diffuser passage 78 gradually increases from the introduction space 77 toward the discharge space 79. Then, in the diffuser passage 78, a pressure of air from the introduction space 77 increases. Thus, the diffuser passage 78 allows the pressure of the air introduced from the radial passages 70 into the motor chamber 18 to increase.

Discharge Port 80

As illustrated in FIG. 2, the housing 11 includes a discharge port 80. The discharge port 80 is formed in the first plate 15 closer to the impeller chamber 23 than the motor chamber 18 is. The discharge port 80 extends inside the first plate 15 in the radial direction of the tubular member 41. A first end of the discharge port 80 is opened at an outer peripheral surface of the first plate 15. A second end of the discharge port 80 is disposed inside the first plate 15. The air introduced from the inlet 22 into the motor chamber 18 through the axial passage 60 and the radial passages 70 is discharged from the discharge port 80 to an outside of the housing 11.

The housing 11 includes a first discharge passage 81, a second discharge passage 82, a third discharge passage 83, and a fourth discharge passage 84. The first discharge passage 81 extends through the first plate 15. The inside of the first radial beating holding portion 21 is connected to the discharge port 80 through the first discharge passage 81. A first end of the first discharge passage 81 communicates with the inside of the first radial bearing holding portion 21. A second end of the first discharge passage 81 communicates with the discharge port 80. The air inside the first radial bearing holding portion 21 flows toward the discharge port 80 through the first discharge passage 81.

The second discharge passage 82 extends through an inside of the first plate 15. The motor chamber 18 is connected to the thrust bearing accommodation chamber 19 through the second discharge passage 82. A first end of the second discharge passage 82 communicates with a space in the motor chamber 18 closer to the first plate 15 than to the stator 32. A second end of the second discharge passage 82 is opened at an inner peripheral surface of the second recess 15*d*. The second end of the second discharge passage 82 communicates with the thrust bearing accommodation chamber 19. The air inside the motor chamber 18 flows toward the thrust bearing accommodation chamber 19 through the second discharge passage 82.

The third discharge passage 83 extends through an inside of the seal plate 17 and the inside of the first plate 15. The shaft insertion hole 17*h* is connected to the discharge port 80 through the third discharge passage 83. A first end of the third discharge passage 83 communicates with an inside of the shaft insertion hole 17*h*. A second end of the third discharge passage 83 communicates with the discharge port 80. Thus, the third discharge passage 83 is connected to the thrust bearing accommodation chamber 19 through the shaft insertion hole 17*h*. The air inside the thrust bearing accommodation chamber 19 flows from a wall portion of the thrust bearing accommodation chamber 19 close to the first thrust bearing portion 53*a* toward the discharge port 80 through the third discharge passage 83.

As illustrated in FIG. 1, the fourth discharge passage 84 extends through the second plate 16 and the motor housing 12. The shaft insertion hole 16*h* is connected to the discharge port 80 through the fourth discharge passage 84. A first end of the fourth discharge passage 84 communicates with an inside of the shaft insertion hole 16*h*. A second end of the fourth discharge passage 84 communicates with the discharge port 80. The air inside the shaft insertion hole 16*h* flows toward the discharge port 80 through the fourth discharge passage 84.

Operation of First Embodiment

The following will describe an operation of the first embodiment.

Part of the air from the inlet 22 is introduced into the axial passage 60 and flows through the axial passage 60 and the radial passages 70. The air flowing through the radial passages 70 is introduced into the introduction space 77 inside the motor chamber 18. The permanent magnet 42 is cooled by the air flowing through the axial passage 60. Thus, the permanent magnet 42 is cooled by the air having a temperature lower than that of the compressed air.

Part of the air introduced from the radial passages 70 into the introduction space 77 flows through the second radial bearing holding portion 26. The second radial bearing 52 is cooled by the air flowing through the second radial bearing holding portion 26. The air having flowed through the second radial bearing holding portion 26 is discharged from the discharge port 80 to the outside of the motor chamber 18 through the shaft insertion hole 16*h* and the fourth discharge passage 84.

In the diffuser passage 78, a pressure of the part of the air introduced from the radial passages 70 into the introduction space 77 increases, and the part of the air flows toward the discharge space 79. Part of the air discharged from the diffuser passage 78 to the discharge space 79 flows through the first radial bearing holding portion 21. The first radial bearing 51 is cooled by the air flowing through the first radial bearing holding portion 21. The air having flowed through the first radial bearing holding portion 21 is discharged from the discharge port 80 to the outside of the motor chamber 18 through the first discharge passage 81. As described above, the air having flowed through the diffuser passage 78 inside the motor chamber 18 flows through the first radial bearing holding portion 21, and is then discharged from the discharge port 80 to the outside of the motor chamber 18 through the first discharge passage 81. The diffuser passage 78 allows the pressure of the air introduced from the radial passages 70 into the motor chamber 18 to increase, and the air flows toward the discharge port 80.

The part of the air discharged from the diffuser passage 78 to the discharge space 79 flows from a part of a space inside the motor chamber 18 closer to the first plate 15 than to the stator 32, into the thrust bearing accommodation chamber 19 through the second discharge passage 82. Then, the air having flowed into the thrust bearing accommodation chamber 19 is divided into air flowing toward the first thrust bearing portion 53*a* and air flowing toward the second thrust bearing portion 53*b*.

The air having flowed toward the first thrust bearing portion 53*a* is discharged from the discharge port 80 to the outside of the motor chamber 18 through the third discharge passage 83. The first thrust bearing portion 53*a* is cooled by the air flowing inside the thrust bearing accommodation chamber 19 toward the first thrust bearing portion 53*a*. The thrust bearing accommodation chamber 19 communicates with the first radial bearing holding portion 21. Thus, the air having flowed toward the second thrust bearing portion 53*b* flows into the first radial beating holding portion 21 and is discharged from the discharge port 80 to the outside of the motor chamber 18 through the first discharge passage 81. The second thrust bearing portion 53*b* is cooled by the air flowing inside the thrust bearing accommodation chamber 19 toward the second thrust beating portion 53*b*.

The dimension of each of the radial passages 70 in the circumferential direction of the second shaft member 45 gradually increases toward the radially outward side of the second shaft member 45. Thus, the air flowing through the radial passages 70 easily flows in the radially outward direction of the second shaft member 45 due to a centrifugal force caused by rotation of the second shaft member 45. In particular, each of the radial passages 70 extends in a direction away from the permanent magnet 42 as being away from the axial passage 60. The dimension of each of the radial passages 70 in the axial direction of the second shaft member 45 gradually decreases toward the radially outward side of the second shaft member 45. Therefore, the air flowing through the radial passages 70 is easily compressed due to the centrifugal force caused by the rotation of the second shaft member 45. As a result, the part of the air from the inlet 22 is easily drawn toward the axial passage 60.

As illustrated in FIG. 6, the dimension H1 of each of the interposed surfaces 76 in the circumferential direction of the second shaft member 45 is smaller than the dimension H2 of the opening 71 of each of the radial passages 70 in the circumferential direction of the second shaft member 45. Thus, air stagnating near the interposed surfaces 76 in the motor chamber 18 is relatively reduced. This prevents the air stagnating near the interposed surfaces 76 in the motor chamber 18 from interrupting a flow of the air introduced from the radial passages 70 into the motor chamber 18. As a result, the part of the air from the inlet 22 is easily introduced into the motor chamber 18 through the axial passage 60 and the radial passages 70, so that the air easily flows through the axial passage 60. Therefore, the permanent magnet 42 is efficiently cooled.

Effects of First Embodiment

The following effects are obtained in the first embodiment.

(1-1) The dimension of each of the radial passages 70 in the circumferential direction of the second shaft member 45 gradually increases toward the radially outward side of the second shaft member 45. Thus, the air flowing through the radial passages 70 easily flows in the radially outward direction of the second shaft member 45 due to the centrifugal force caused by the rotation of the second shaft member 45. The dimension H1 of each of the interposed surfaces 76 in the circumferential direction of the second shaft member 45 is smaller than the dimension H2 of the opening 71 of each of the radial passages 70 in the circumferential direction of the second shaft member 45. Thus, air stagnating near each of the interposed surfaces 76 in the motor chamber 18 is relatively reduced. This prevents the air stagnating near each of the interposed surfaces 76 in the motor chamber 18 from interrupting a flow of the air introduced from the radial passages 70 into the motor chamber 18. As a result, the part of the air from the inlet 22 is easily introduced into the motor chamber 18 through the axial passage 60 and the radial passages 70, so that the air easily flows through the axial passage 60. Therefore, the permanent magnet 42 is efficiently cooled.

(1-2) Each of the radial passages 70 extends in a direction away from the permanent magnet 42 as being away from the axial passage 60. Accordingly, the air flowing through the radial passages 70 is easily compressed due to the centrifugal force caused by the rotation of the second shaft member 45. Thus, the part of the air from the inlet 22 is easily further drawn toward the axial passage 60. As a result, the air easily flows through the axial passage 60, which efficiently further cools the permanent magnet 42.

(1-3) The dimension of each of the radial passages 70 in the axial direction of the second shaft member 45 gradually decreases toward the radially outward side of the second shaft member 45. Thus, the air flowing through the radial passages 70 is easily further compressed due to the centrifugal force caused by the rotation of the second shaft member 45. Accordingly, part of the air from the inlet 22 is further easily drawn toward the axial passage 60. As a result, the air easily flows through the axial passage 60, which efficiently further cools the permanent magnet 42.

(1-4) The centrifugal compressor 10 includes the diffuser passage 78 allowing the pressure of the air introduced from the radial passages 70 into the motor chamber 18 to increase and allowing the air to flow toward the discharge port 80. Accordingly, in the diffuser passage 78, the pressure of the air introduced from the radial passages 70 into the motor chamber 18 increases, and the airflows toward the discharge port 80 and is discharged from the discharge port 80. Thus, the air introduced from the radial passages 70 into the motor chamber 18 is easily discharged from the discharge port 80. As a result, the part of the air from the inlet 22 is easily drawn toward the axial passage 60. Thus, the air easily further flows through the axial passage 60, which efficiently further cools the permanent magnet 42.

Second Embodiment

The following will describe a second embodiment of a centrifugal compressor with reference to FIG. 8 to FIG. 12. The components of the second embodiment corresponding to those of the first embodiment are designated by the same reference numerals, and redundant description will be omitted. Unlike the first embodiment, in the second embodiment, an axial passage 87 and radial passages 98 are provided in the first shaft member 44, without being provided in the second shaft member 45. Unlike the first embodiment, in the second embodiment, the axial passage 87 does not extend through the permanent magnet 42. Unlike the first embodiment, in the second embodiment, the centrifugal compressor 10 does not include a diffuser passage.

Figure 8:
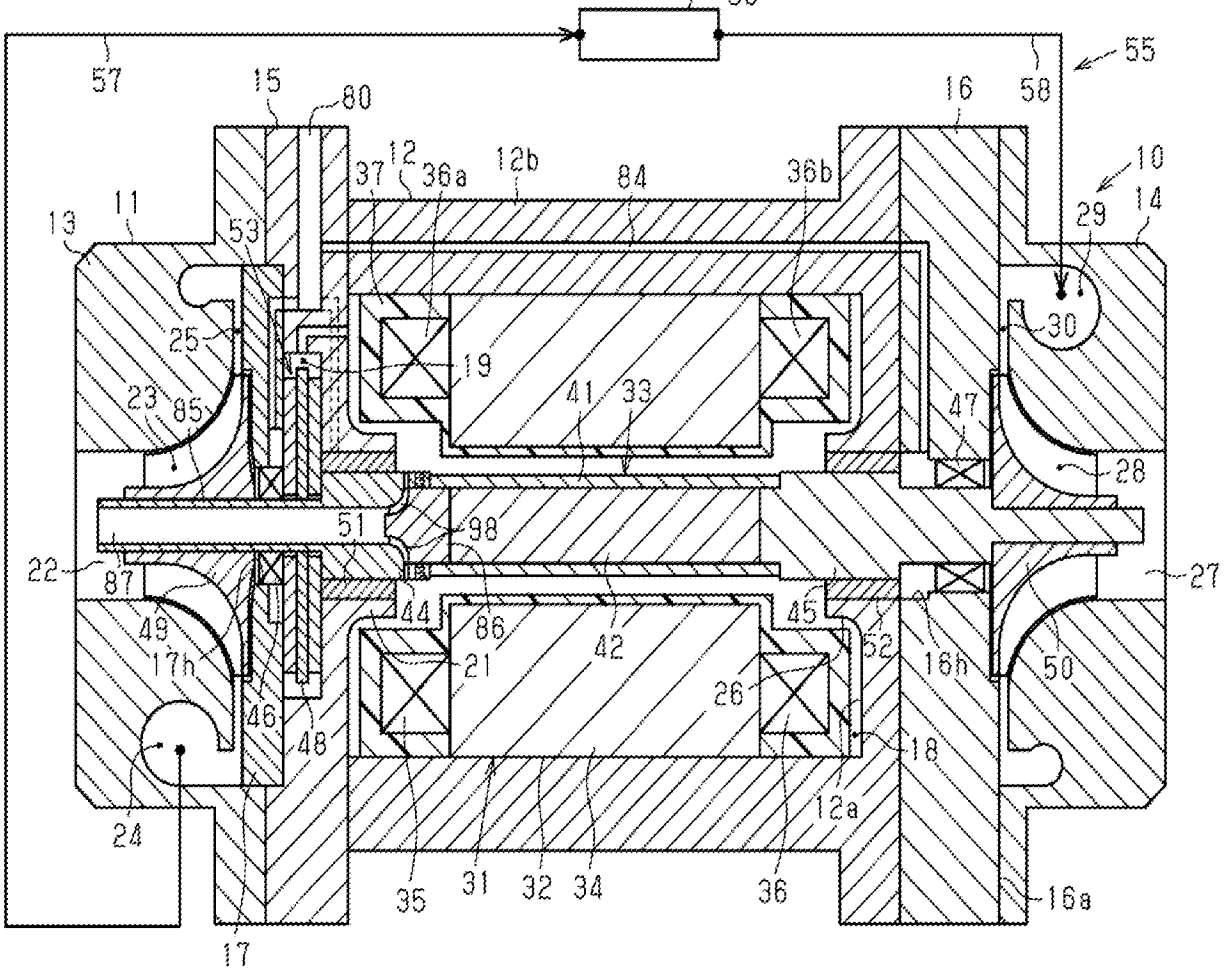
FIG. 8 is a cross-sectional view of a centrifugal compressor according to a second embodiment.
Figure 9:
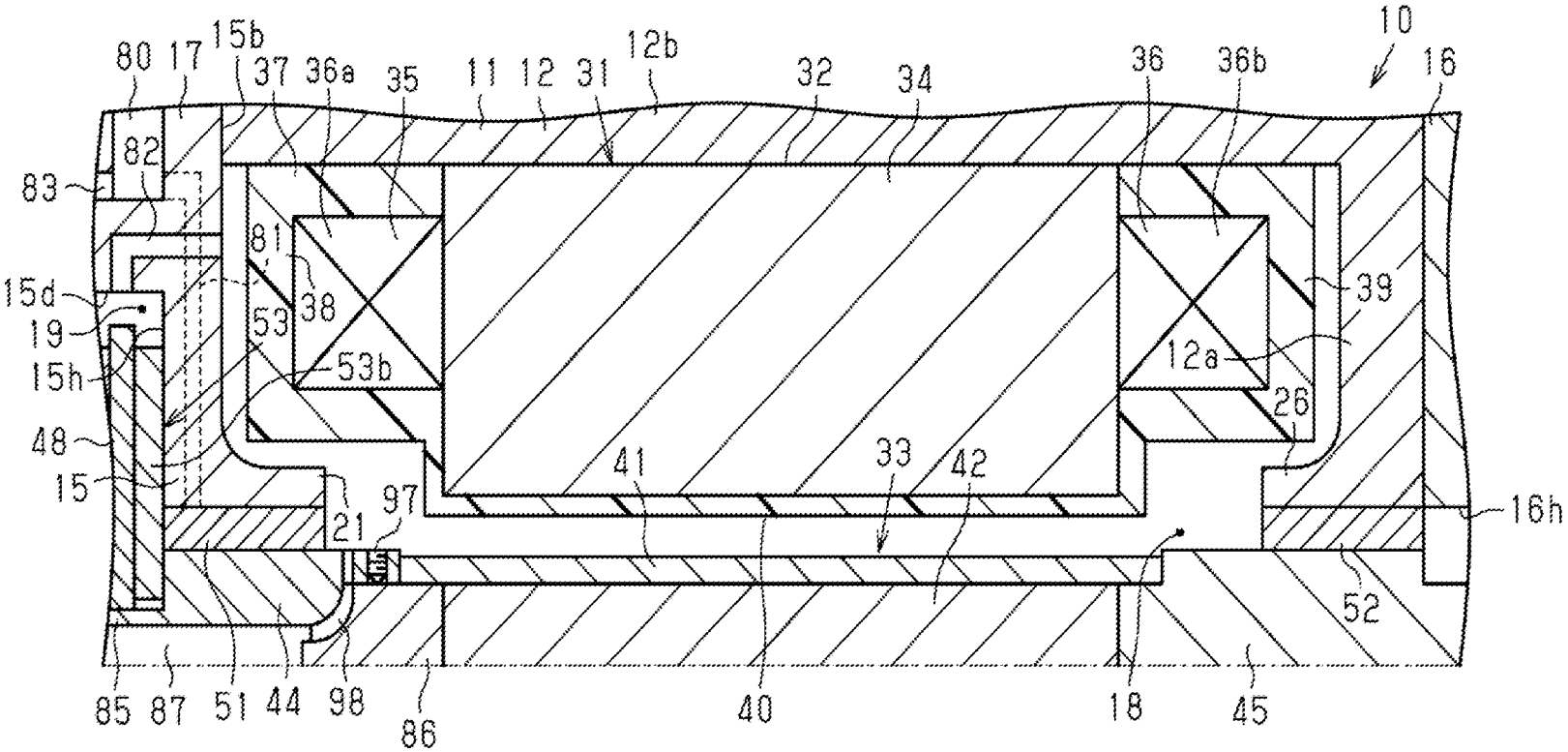
FIG. 9 is an enlarged cross-sectional view of a part of the centrifugal compressor.

As illustrated in FIG. 8 and FIG. 9, the first shaft member 44 includes a pipe portion 85 and an impeller portion 86. The pipe portion 85 extends through the compressor impeller 49. A first end of the pipe portion 85 projects from a distal end surface of the compressor impeller 49. An inside of the pipe portion 85 is included in the axial passage 87. That is, the pipe portion 85 forms the axial passage 87. Thus, the axial passage 87 is provided in the first shaft member 44. The rotor 33 includes the axial passage 87.

The axial passage 87 is formed coaxially with the pipe portion 85. A first end of the axial passage 87 is opened at a first end surface of the pipe portion 85. Thus, the axial passage 87 is opened at one end of the first shaft member 44 close to the compressor impeller 49, and communicates with the inlet 22. The axial passage 87 extends inside the rotor 33 in the axial direction of the rotor 33.

Figure 10:
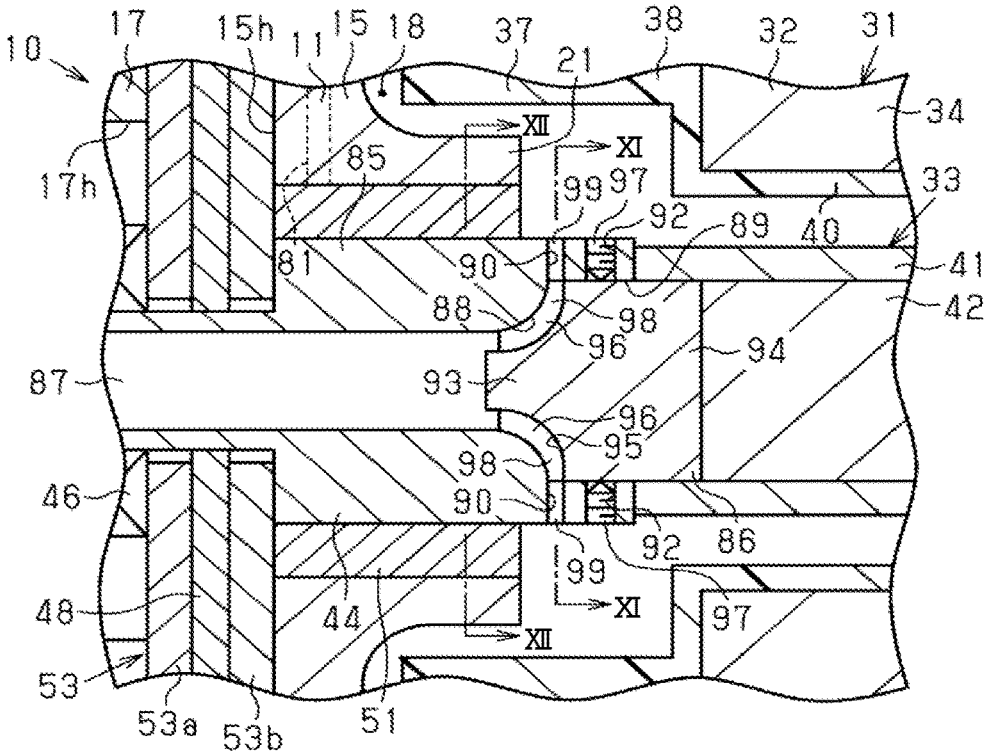
FIG. 10 is an enlarged cross-sectional view of a part of the centrifugal compressor.

As illustrated in FIG. 10, the pipe portion 85 includes a shroud surface 88. The shroud surface 88 is continuous with a second end of the axial passage 87. That is, the shroud surface 88 is continuous with an end portion of the axial passage 87 opposite from the inlet 22. The shroud surface 88 extends in a direction away from the inlet 22 as being away from the axial passage 87. The shroud surface 88 is a convex surface curved in an arc shape that projects toward an axis of the pipe portion 85.

The pipe portion 85 includes a mounting hole 89. The mounting hole 89 extends in the axial direction of the rotor 33. The mounting hole 89 is formed coaxially with the pipe portion 85. A first end of the mounting hole 89 is continuous with an end portion of the shroud surface 88 opposite from the axial passage 87. The shroud surface 88 connects an inner peripheral surface of the pipe portion 85 forming the axial passage 87 and an inner peripheral surface of the mounting hole 89. A diameter of the mounting hole 89 is larger than that of the axial passage 87. A second end of the mounting hole 89 is opened at a second end surface of the pipe portion 85.

The pipe portion 85 includes a plurality of radial holes 90. Each of the radial holes 90 extends in a radial direction of the pipe portion 85. Each of the radial holes 90 has a square hole shape. A first end of each of the radial holes 90 is opened at the inner peripheral surface of the mounting hole 89. A part of an opened edge of the first end of each of the radial holes 90 is continuous with the end portion of the shroud surface 88 opposite to the axial passage 87. A second end of each of the radial holes 90 is opened at an outer peripheral surface of the pipe portion 85. The second end of each of the radial holes 90 communicates with the inside of the motor chamber 18. Specifically, the second end of each of the radial holes 90 communicates with a part of a space inside the motor chamber 18 radially inward with respect to the first coil end 36*a*. Each of the radial holes 90 extends from the inner peripheral surface of the mounting hole 89 toward the outer peripheral surface of the pipe portion 85, and communicates with the inside of the motor chamber 18.

Figure 11:
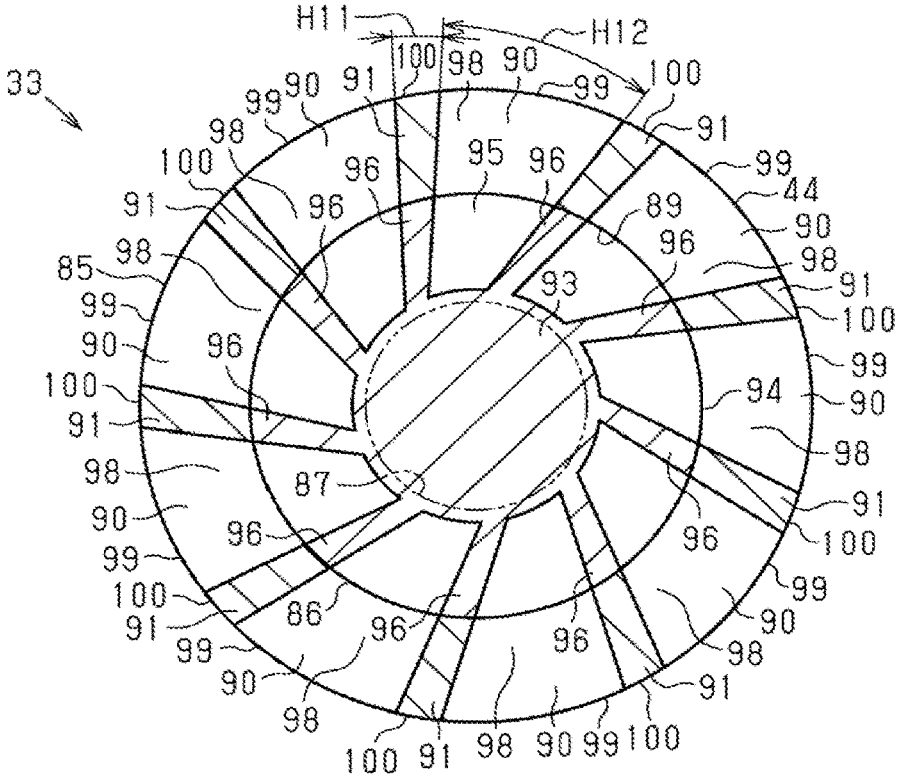
FIG. 11 is a cross-sectional view of the centrifugal compressor, taken along a line XI-XI of FIG. 10.

As illustrated in FIG. 11, a dimension of each of the radial holes 90 in a circumferential direction of the pipe portion 85 gradually increases toward a radially outward side of the pipe portion 85. The pipe portion 85 has a plurality of interposed walls 91. Each of the interposed walls 91 is interposed between the radial holes 90 adjacent to each other arranged along the circumferential direction of the pipe portion 85. A width of each of the interposed walls 91 in the circumferential direction of the pipe portion 85 gradually increases toward the radially outward side of the pipe portion 85.

As illustrated in FIG. 10, the pipe portion 85 includes a plurality of internal threaded holes 92. Each of the internal threaded holes 92 extends in the radial direction of the pipe portion 85. A first end of each of the internal threaded holes 92 is opened at the inner peripheral surface of the mounting hole 89. Specifically, the first end of each of the internal threaded holes 92 is opened at a position closer to a second end surface of the pipe portion 85 than to a position in which each of the radial holes 90 is opened at the inner peripheral surface of the mounting hole 89. A second end of each of the internal threaded holes 92 is opened at the outer peripheral surface of the pipe portion 85. Specifically, the second end of each of the internal threaded holes 92 is opened at a position closer to the second end surface of the pipe portion 85 than to a position in which each of the radial holes 90 is opened at the outer peripheral surface of the pipe portion 85.

The impeller portion 86 includes a hub portion 93 and a mounting portion 94. The hub portion 93 has a cylindrical columnar shape. The hub portion 93 has a hub surface 95. The hub surface 95 extends along the shroud surface 88. The hub surface 95 has a concave arc shape curved toward an axis of the hub portion 93. The hub surface 95 gradually approaches the shroud surface 88 as being away from the axial passage 87. The mounting portion 94 has a cylindrical columnar shape. The mounting portion 94 is inserted into the mounting hole 89. A part of the mounting portion 94 projects from the mounting hole 89.

As illustrated in FIG. 10 and FIG. 11, the impeller portion 86 has a plurality of blade walls 96. Each of the blade walls 96 stands from the hub surface 95. Each of the blade walls 96 extends from the hub surface 95 toward the shroud surface 88. An outer edge of each of the blade walls 96 close to the shroud surface 88 extends along the shroud surface 88. The outer edge of each of the blade walls 96 close to the shroud surface 88 is in contact with the shroud surface 88.

As illustrated in FIG. 11, opposite side surfaces of each of the blade walls 96 in a circumferential direction of the impeller portion 86 and opposite side surfaces of each of the interposed walls 91 in the circumferential direction of the pipe portion 85 are positioned on the same flat surfaces, respectively. A space between the shroud surface 88 and the hub surface 95, between the blade walls 96 adjacent to each other in the circumferential direction of the impeller portion 86 communicates with each of the radial holes 90.

As illustrated in FIG. 10, a screw 97 is screwed into each of the internal threaded holes 92. The screw 97 screwed into each of the internal threaded holes 92 is in contact with an outer peripheral surface of the mounting portion 94, so that the pipe portion 85 is fixed to the impeller portion 86 with the screw 97. Thus, the pipe portion 85 is integrated with the impeller portion 86 with the screw 97, which forms the first shaft member 44. A part of the mounting portion 94 projecting from the mounting hole 89 is inserted into a first end of the tubular member 41. The mounting portion 94 is press-fitted into an inner peripheral surface of the first end of the tubular member 41. As a result, the first shaft member 44 is fixed to the tubular member 41.

The rotor 33 includes a plurality of radial passages 98. Each of the radial passages 98 is formed by each of the radial holes 90 and a space between the shroud surface 88 and the hub surface 95, between the blade walls 96 adjacent to each other in the circumferential direction of the impeller portion 86.

Figure 12:
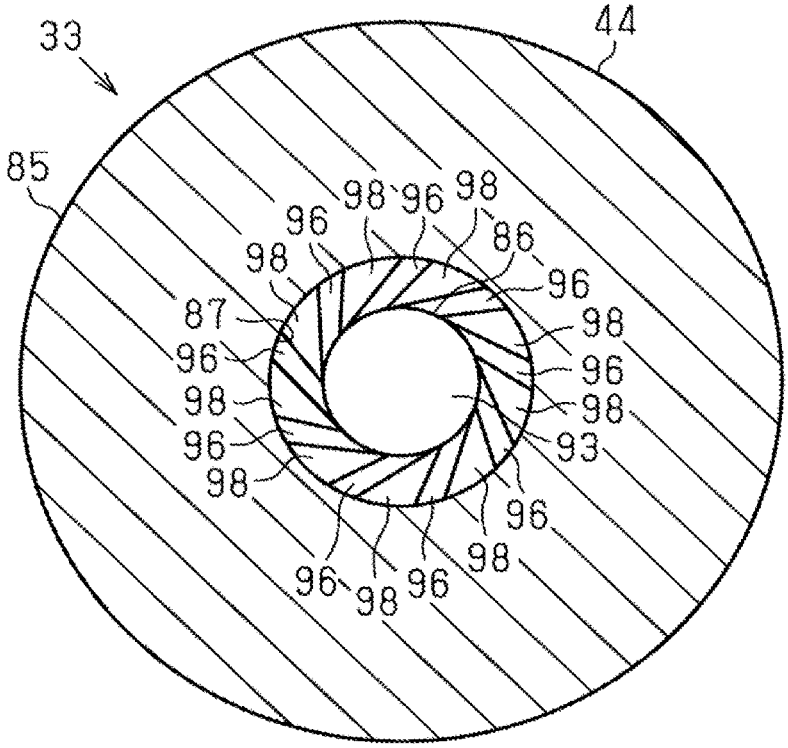
FIG. 12 is a cross-sectional view of the centrifugal compressor, taken along a line XII-XII of FIG. 10.

As illustrated in FIG. 12, an end portion of each of the blade walls 96 located on a radially inward side of the first shaft member 44 faces an inside of the axial passage 87. Thus, a first end of each of the radial passages 98 communicates with a second end of the axial passage 87. Each of the radial passages 98 communicates with the axial passage 87, and extends from the axial passage 87 toward the outer peripheral surface of the first shaft member 44.

As illustrated in FIG. 10, a second end of each of the radial passages 98 is opened at the outer peripheral surface of the pipe portion 85, and communicates with the inside of the motor chamber 18. That is, each of the radial passages 98 has an opening 99 that is opened at the outer peripheral surface of the pipe portion 85. Thus, the opening 99 is opened at the outer peripheral surface of the first shaft member 44. The opening 99 of each of the radial passages 98 corresponds to a part of each of the radial holes 90 that is opened at the outer peripheral surface of the pipe portion 85.

As illustrated in FIG. 11, the outer peripheral surface of the first shaft member 44 includes a plurality of interposed surfaces 100. Each of the interposed surfaces 100 is interposed between openings 99 of the radial passages 98 adjacent to each other arranged along the circumferential direction of the first shaft member 44. Each of the interposed surfaces 100 corresponds to an outer surface of each of the interposed walls 91 of the pipe portion 85.

A dimension of each of the radial passages 98 in the circumferential direction of the first shaft member 44 gradually increases toward a radially outward side of the first shaft member 44. Thus, the opening 99 of each of the radial passages 98 corresponds to the largest dimension in each of the radial passages 98 in the circumferential direction of the first shaft member 44. A dimension H11 of each of the interposed surfaces 100 in the circumferential direction of the first shaft member 44 is smaller than a dimension H12 of the opening 99 in the circumferential direction of the first shaft member 44.

As illustrated in FIG. 10, each of the radial passages 98 extends in a direction away from the inlet 22 as being away from the axial passage 87. A dimension of each of the radial passages 98 in the axial direction of the first shaft member 44 gradually decreases toward the radially outward side of the first shaft member 44. Each of the radial passages 98 extends in the radial direction of the first shaft member 44, and communicates with the inside of the motor chamber 18. Each of the radial passages 98 communicates with a part of a space inside the motor chamber 18 radially inward with respect to the first coil end 36*a*. Then, the air introduced from the inlet 22 into the axial passage 87 is introduced into the motor chamber 18 through the radial passages 98.

Operation of Second Embodiment

The following will describe an operation of the second embodiment.

The part of the air from the inlet 22 is introduced into the axial passage 87 and flows through the axial passage 87 and the radial passages 98. The air flowing through the radial passages 98 is introduced into the motor chamber 18. The permanent magnet 42 is cooled by the air introduced into the motor chamber 18. A temperature of the air introduced into the motor chamber 18 is lower than that of the compressed air, which efficiently cools the permanent magnet 42.

The dimension of each of the radial passages 98 in the circumferential direction of the first shaft member 44 gradually increases toward the radially outward side of the first shaft member 44. Thus, the air flowing through the radial passages 98 easily flows in a radially outward direction of the first shaft member 44 due to the centrifugal force caused by the rotation of the first shaft member 44. In particular, each of the radial passages 98 extends in a direction away from the inlet 22 as being away from the axial passage 87. The dimension of each of the radial passages 98 in the axial direction of the first shaft member 44 gradually decreases toward the radially outward side of the first shaft member 44. Therefore, the air flowing through the radial passages 98 is easily compressed due to the centrifugal force caused by the rotation of the first shaft member 44. As a result, the part of the air from the inlet 22 is easily drawn toward the axial passage 87.

As illustrated in FIG. 11, the dimension H11 of each of the interposed surfaces 100 in the circumferential direction of the first shaft member 44 is smaller than the dimension H12 of the opening 99 of each of the radial passages 98 in the circumferential direction of the first shaft member 44. Thus, air stagnating near each of the interposed surfaces 100 in the motor chamber 18 is relatively reduced. This prevents the air stagnating near each of the interposed surfaces 100 in the motor chamber 18 from interrupting a flow of the air introduced from the radial passages 98 into the motor chamber 18. As a result, the part of the air from the inlet 22 is easily introduced into the motor chamber 18 through the axial passage 87 and the radial passages 98. Therefore, the permanent magnet 42 is efficiently cooled.

Effects of Second Embodiment

The following effects are obtained in the second embodiment.

(2-1) The dimension of each of the radial passages 98 in the circumferential direction of the first shaft member 44 gradually increases toward the radially outward side of the first shaft member 44. Thus, the air flowing through the radial passages 98 easily flows in the radially outward direction of the first shaft member 44 due to the centrifugal force caused by the rotation of the first shaft member 44. The dimension H11 of each of the interposed surfaces 100 in the circumferential direction of the first shaft member 44 is smaller than the dimension H12 of the opening 99 of each of the radial passages 98 in the circumferential direction of the first shaft member 44. Thus, air stagnating near each of the interposed surfaces 100 in the motor chamber 18 is relatively reduced. This prevents the air stagnating near each of the interposed surfaces 100 in the motor chamber 18 from interrupting a flow of the air introduced from the radial passages 98 into the motor chamber 18. As a result, the part of the air from the inlet 22 is easily introduced into the motor chamber 18 through the axial passage 87 and the radial passages 98. Therefore, the permanent magnet 42 is efficiently cooled.

(2-2) Each of the radial passages 98 extends in a direction away from the inlet 22 as being away from the axial passage 87. Accordingly, the air flowing through the radial passages 98 is easily compressed due to the centrifugal force caused by the rotation of the first shaft member 44. Thus, the part of the air from the inlet 22 is easily further drawn toward the axial passage 87. As a result, the air easily introduced into the motor chamber 18, which efficiently further cools the permanent magnet 42.

(2-3) The dimension of each of the radial passages 98 in the axial direction of the first shaft member 44 gradually decreases toward the radially outward side of the first shaft member 44. Thus, the air flowing through the radial passages 98 is easily further compressed due to the centrifugal force caused by the rotation of the first shaft member 44. Accordingly, part of the air from the inlet 22 is further easily drawn toward the axial passage 87. As a result, the air is easily further introduced into the motor chamber 18, which efficiently further cools the permanent magnet 42.

Modified Embodiment

The aforementioned embodiments may be modified as below. The embodiments may be combined with the following modified embodiment within a technically consistent range.

Figure 13:
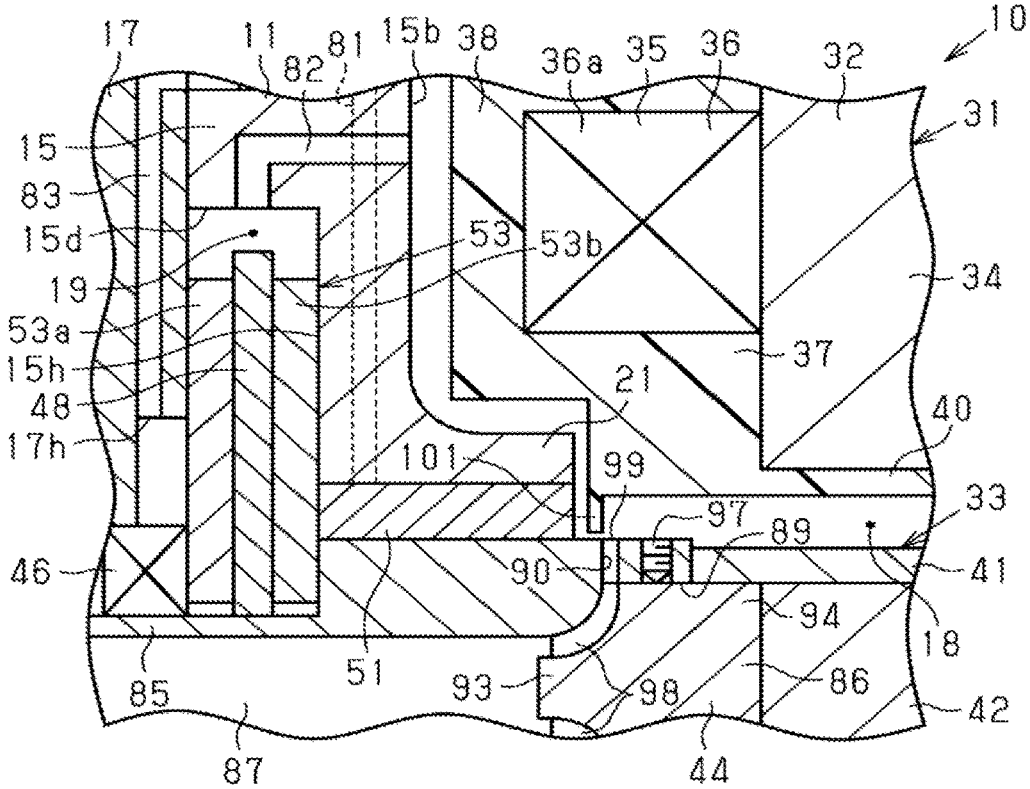
FIG. 13 is an enlarged cross-sectional view of a part of a centrifugal compressor according to a modified embodiment.

As illustrated in FIG. 13, in the second embodiment, the centrifugal compressor 10 may include a partition wall 101. The resin member 37 includes the partition wall 101. The partition wall 101 has an annular shape and projects from a part of the resin member 37 slightly closer to the first radial bearing holding portion 21 than to a part of the resin member 37 corresponding to the opening 99 of each of the radial passages 98 in the radial direction of the first shaft member 44. The partition wall 101 causes the air introduced from the radial passages 98 into the motor chamber 18 to be guided toward a space between the stator 32 and the rotor 33.

Accordingly, the partition wall 101 causes the air introduced from the radial passages 98 into the motor chamber 18 to be guided toward the space between the stator 32 and the rotor 33. Thus, the air introduced from the radial passages 98 into the motor chamber 18 easily flows through the space between the stator 32 and the rotor 33, so that the air flowing through the space between the stator 32 and the rotor 33 efficiently further cools the permanent magnet 42.

In the first embodiment, each of the radial passages 70 may extend from the axial passage 60 in the radial direction of the second shaft member 45. For example, the plurality of radial passages 70 may extend radially from the third axial passage 63 about an axis of the third axial passage 63. That is, each of the radial passages 70 need not extend in a direction away from the permanent magnet 42 as being away from the axial passage 60.

In the second embodiment, each of the radial passages 98 may extend from the axial passage 87 in the radial direction of the first shaft member 44. For example, the plurality of radial passages 98 may extend radially from the axial passage 87 about an axis of the axial passage 87. That is, each of the radial passages 98 need not extend in a direction away from the inlet 22 as being away from the axial passage 87.

In the first embodiment, for example, each of the radial passages 70 may extend from the axial passage 60 toward the outer peripheral surface of the second shaft member 45 in a state where the dimension of each of the radial passages 70 in the axial direction of the second shaft member 45 is fixed. That is, the dimension of each of the radial passages 70 in the axial direction of the second shaft member 45 need not gradually decrease toward the radially outward side of the second shaft member 45.

In the second embodiment, for example, each of the radial passages 98 may extend from the axial passage 87 toward the outer peripheral surface of the first shaft member 44 in a state where the dimension of each of the radial passages 98 in the axial direction of the first shaft member 44 is fixed. That is, the dimension of each of the radial passages 98 in the axial direction of the first shaft member 44 need not gradually decrease toward the radially outward side of the first shaft member 44.

In the first embodiment, the dimension of each of the radial passages 70 in the axial direction of the second shaft member 45 may gradually increase toward the radially outward side of the second shaft member 45.

In the second embodiment, the dimension of each of the radial passages 98 in the axial direction of the first shaft member 44 may gradually increase toward the radially outward side of the first shaft member 44.

In each of the embodiments, the discharge port 80 may be formed on the peripheral wall 12*b* of the motor housing 12, for example. The discharge port 80 may communicate with a space inside the motor chamber 18 closer to the first plate 15 than to the stator 32. In this case, the housing 11 need not include the first discharge passage 81, the second discharge passage 82, and the third discharge passage 83.

In the first embodiment, an inner peripheral surface of the stator core 34 need not be covered with resin. The inner peripheral surface of the stator core 34 may be formed into a conical hole in which an inner diameter of the inner peripheral surface of the stator core 34 increases from the second coil end 36*b* toward the first coil end 36*a*. As a result, the diffuser passage 78 may be formed between the inner peripheral surface of the stator core 34 and the outer peripheral surface of the tubular member 41.

In the first embodiment, the inner diameter of the inner peripheral surface of the third resin portion 40 may be fixed. The outer peripheral surface of the tubular member 41 may be a conical surface in which an outer diameter of the outer peripheral surface of the tubular member 41 increases from the second shaft member 45 toward the first shaft member 44. As a result, the diffuser passage 78 may be formed between the inner peripheral surface of the third resin portion 40 and the outer peripheral surface of the tubular member 41. The diffuser passage 78 is simply required to be formed between the stator 32 and the rotor 33.

In the first embodiment, the centrifugal compressor 10 need not include the diffuser passage 78.

In each of the embodiments, the permanent magnet 42 may be adhered to the inner peripheral surface of the tubular member 41 with an adhesive agent, for example, without being press-fitted into the inner peripheral surface of the tubular member 41. That is, the permanent magnet 42 is simply required to be fixed to the inside of the tubular member 41.

In each of the embodiments, the centrifugal compressor 10 need not include the turbine wheel 50.

In each of the embodiments, the centrifugal compressor 10 may include another compressor impeller instead of the turbine wheel 50. That is, the centrifugal compressor 10 may be configured such that compressor impellers are attached to the first shaft member 44 and the second shaft member 45, respectively. Air compressed by one of the compressor impellers may be compressed again by the other of the compressor impellers.

In each of the embodiments, a magnetic body is not limited to the permanent magnet 42, but may be a laminated core, an amorphous core, or a dust core, for example.

In each of the embodiments, the tubular member 41 may be made of carbon fiber-reinforced plastics, for example. That is, the tubular member 41 may be made of any material.

In each of the embodiments, the centrifugal compressor 10 need not be mounted on the fuel cell vehicle. That is, the centrifugal compressor 10 may be mounted on any object other than a vehicle.

What is claimed is:

1. A centrifugal compressor comprising:

a compressor impeller that compresses air;

a motor that rotates the compressor impeller; and a housing including an impeller chamber accommodating the compressor impeller, a motor chamber accommodating the motor, and an inlet from which air is drawn into the impeller chamber, the motor including a stator fixed to the housing and a rotor disposed inside the stator, the rotor including a tubular member, a magnetic body fixed to an inside of the tubular member, and a first shaft member and a second shaft member on opposite sides of the magnetic body in an axial direction of the tubular member, the compressor impeller being connected to the first shaft member, wherein the rotor further includes:

an axial passage that extends inside the rotor in an axial direction of the rotor and is opened at one end of the first shaft member close to the compressor impeller to communicate with the inlet; and a plurality of radial passages that communicates with the axial passage and extends from the axial passage toward an outer peripheral surface of the second shaft member to communicate with an inside of the motor chamber, the housing includes a discharge port from which air introduced from the inlet into the motor chamber is discharged to an outside of the housing, a dimension of each of the radial passages in a circumferential direction of the second shaft member gradually increases toward a radially outward side of the second shaft member, each of the radial passages includes an opening that is opened at the outer peripheral surface of the second shaft member, the outer peripheral surface of the second shaft member has an interposed surface that is interposed between the opening of one of the radial passages and the opening of another of the radial passages adjacent to each other in the circumferential direction of the second shaft member, and a dimension of the interposed surface in the circumferential direction of the second shaft member is smaller than a dimension of the opening in the circumferential direction of the second shaft member, wherein the axial passage is partially defined by the magnetic body—has been inserted.

2. The centrifugal compressor according to claim 1, wherein each of the radial passages extends in a direction away from the magnetic body as being away from the axial passage.

3. The centrifugal compressor according to claim 2, wherein a dimension of each of the radial passages in an axial direction of the second shaft member gradually decreases toward the radially outward side of the second shaft member.

4. The centrifugal compressor according to claim 1 further comprising a diffuser passage that is provided between the stator and the rotor, and allows a pressure of air introduced from the radial passages into the motor chamber to increase and the air to flow toward the discharge port.

* * * * *